US006736048B2

(12) United States Patent
Riedhammer et al.

(10) Patent No.: US 6,736,048 B2
(45) Date of Patent: May 18, 2004

(54) HYDROSTATIC AXIAL PISTON MACHINE

(75) Inventors: Josef Riedhammer, Horb am Neckar (DE); Erich Eckhardt, Sorens (CH); Franz-Josef Schwede, Murten (CH)

(73) Assignee: Liebherr Machines Bulle SA, Bulle (CH)

( * ) Notice: Subject to any disclaimer, the term of this patent is extended or adjusted under 35 U.S.C. 154(b) by 0 days.

(21) Appl. No.: 09/908,107

(22) Filed: Jul. 18, 2001

(65) Prior Publication Data

US 2002/0108489 A1 Aug. 15, 2002

(30) Foreign Application Priority Data

Jul. 18, 2000 (DE) ..... 100 34 857

(51) Int. Cl.[7] ..... F04B 27/08; F01B 13/04

(52) U.S. Cl. ..... 91/504; 91/505; 92/57; 417/269; 417/270

(58) Field of Search ..... 417/269, 270, 417/540, 642; 91/499, 504, 505; 92/57, 71

(56) References Cited

U.S. PATENT DOCUMENTS

| | | | | |
|---|---|---|---|---|
| 3,180,274 A | | 4/1965 | Sisk | |
| 5,555,726 A | | 9/1996 | Huebner | |
| 5,572,919 A | * | 11/1996 | Ishizaki | 91/499 |
| 5,634,776 A | | 6/1997 | Leemhuis et al. | |
| 6,361,285 B1 | * | 3/2002 | Lehner | 417/269 |
| 6,510,779 B2 | * | 1/2003 | Greene et al. | 91/504 |

FOREIGN PATENT DOCUMENTS

| | | |
|---|---|---|
| DE | 1528367 | 9/1970 |
| DE | 19706114 | 8/1998 |
| DE | 19818721 | 10/1999 |
| DE | 0953767 | 11/1999 |
| EP | 1013928 | 6/2000 |
| GB | 1367512 | 9/1974 |

* cited by examiner

*Primary Examiner*—Charles G. Freay
(74) *Attorney, Agent, or Firm*—Dilworth & Barrese LLP

(57) ABSTRACT

A hydrostatic axial piston machine has a drum-like cylinder block which is supported in a manner fixed against rotation on a driving or output shaft and is provided concentrically and parallel to its center line with cylinder boreholes in which axially displaceable pistons are arranged which are supported via spherical heads on a slanting disk which is fixed to the housing and preferably adjustable in its slanting angle. The cylinder openings opposite the slanting disk sweep over roughly kidney-shaped low pressure and high pressure control openings of a control body, between which reversing regions with additional boreholes are located. To control the additional boreholes, which influence the pressure increase or the pressure drop on the passing of the cylinder openings over the reversing regions, in dependence on the operating states, a borehole opens at least in a reversing region of the control body which is connected to the high pressure side or the high pressure control opening by a line. A restrictor controlled by the high pressure is arranged in the line which releases a restrictor opening corresponding to the high pressure in the line.

20 Claims, 13 Drawing Sheets

INLET AND OUTLET RESTRICTOR, CONTROLLED

PRESSURE BUILD-UP AND
PRESSURE REDUCTION, CONTROLLED

CONTROL WITH KNOWN PATH – PRESSURE LAW
E.G. POWER REGULATION

HYDROSTATIC AXIAL PISTON MACHINE

BACKGROUND OF THE INVENTION

The invention relates to a hydrostatic axial piston machine having a drum-like cylinder block which is fixedly supported against rotation on a driving shaft or an output shaft and is provided with cylinder boreholes concentrically and parallel to its center line in which axially displaceable pistons are arranged which are supported via spherical heads on a slanting disk which is fixed with respect to the housing and preferably adjustable in its slanting angle, with the cylinder openings opposite the slanting disk sweeping over roughly kidney-shaped low pressure and high pressure control openings of a control body between which reversing regions with additional boreholes are located.

Unwanted pressure and conveyor flow pulsations with a corresponding noise development can occur on the running of the open sides of the cylinder boreholes, or the sides of the cylinder boreholes provided with openings, over the reversing regions located between the low pressure and high pressure control openings, because the open cylinder sides are closed abruptly on running onto the reversing regions and, on running off, are abruptly exposed to a high or low pressure which differs from the pressures prevailing in the cylinder openings.

To alleviate these pressure and conveyor flow pulsations, it is known to connect the run-out and run-in regions of the low pressure and high pressure control openings to the reversing regions by notches or wedge-shaped transitions such as can be seen in FIGS. 13 and 14. It is furthermore known to connect the reversing regions to the low pressure and high pressure control openings by passages such as can be seen in FIGS. 15 and 16.

Since, however, the volumes decisive for the pressure build-up in the cylinder space, namely the dead volume plus the stroke volume, depend on the swivel angle of the slanting disk, the necessary volumes to be supplied for the pressure build-up on the pressure in the high pressure control opening and on the available time interval for the pressure reversing and thus on the speed, an optimum pressure reversing is not possible over the whole operating range with a constant notch between the run-out and run-in regions and the reversing region or with passages connecting the reversing regions to the low pressure and high pressure control openings by passages.

It is generally desired to avoid unwanted pressure and conveyor flow pulsations on the passing of the open cylinder sides over the reversing regions, by the reversing regions being provided with boreholes via which an influencing of the pressure prevailing in the cylinder openings takes place such that a continuous pressure build-up or reduction is assumed in the cylinders on the transition from the low pressure to the high pressure control openings and vice versa. In a hydrostatic machine known from DE 198 18 721 A1, one borehole is respectively disposed in the reversing regions via which a pressure increasing the pressure in the cylinders or a pressure relieving this pressure is applied by pumping and/or loading or load relieving devices. The known hydrostatic machine is, however, complex in that special pumping and/or load relieving devices have to be provided.

SUMMARY OF THE INVENTION

It is the object of the invention to provide a hydrostatic axial piston machine of the kind first mentioned in which the additional boreholes located in the reversing region(s), which influence the pressure increase or the pressure drop on the passing of the cylinder openings over the reversing regions, are controlled in dependence on the operation states, namely the pressure, the speed and the swivel angle of the slanting disk. Furthermore, a hydrostatic axial piston machine should be provided in which an unwanted abrupt increase or drop in the pressure in the cylinders should be avoided in a simple and reliable way even with changed operating conditions on the passing of the cylinder openings over the reversing regions.

This object is solved in accordance with the invention by a borehole, which is connected to the high pressure side or the high pressure control opening by a line, opening at least in one reversing region of the control body and by a restrictor controlled by the high pressure being disposed in the line which releases a restrictor opening corresponding to the high pressure in the line. If the open cylinder side sweeps over the borehole, oil under higher pressure flows from this into the cylinder opening so that the pressure in this increased on passing the reversing region and a continuous pressure increase takes place in the cylinder until the open cylinder side runs into the high pressure control opening. Unwanted abrupt pressure increases and changes to the conveyor flow are thereby avoided.

The borehole appropriately opens in a region of the reversing region which is facing the high pressure control opening.

In accordance with a preferred embodiment, it is planned that, at least in a region of the reversing region of the control body facing the low pressure control opening, a borehole opens which is connected to the low pressure control opening by a line and that a restrictor controlled by the high pressure is disposed in the line, which releases a restrictor opening corresponding to the high pressure in the line. This aspect improves the pressure compensation and results in a continuous pressure drop avoiding abrupt pressure changes prior to and during the running of the open cylinder sides into the low pressure control opening.

The two boreholes in the reversing region are appropriately simultaneously covered by the respective cylinder opening on the passing of each of them. The two boreholes appropriately have respectively equal distances to the low pressure and high pressure control openings in the reversing region(s).

Known solutions, for example of the kind described with reference to FIGS. 13 to 16, have the disadvantage that these only ensure an evening of the pressure increase or of the pressure drop on the passing of the open cylinder sides over the reversing regions for a certain operating mode, for example a certain pressure, of the axial piston machine. The solution of the invention is characterized, in contrast to this, by the boreholes in the reversing regions forming restrictor openings by which a pressure approximation takes place via the controlled restrictor which is carried off from the respective high pressure so that the axial piston machine of the invention also ensures a gentle pressure compensation or an adaptation of the pressure on the passing of the open cylinder sides over the reversing regions with different operating modes and in particular with different pressures.

In accordance with an inventive aspect, it is provided that the controlled restrictor consists of a cylindrical borehole in the control body or a cylinder held in the control body in which borehole or which cylinder a control piston loaded by a compression spring is displaceably guided whose side opposite the compression spring is exposed to the high pressure in the high pressure control opening, that lines open into the cylinder borehole or the cylinder at an axial distance to one another, which lines lead to the borehole of the reversing region and to the high pressure control opening or to the low pressure control opening, and that, corresponding to its displacement, the control piston releases differently sized restrictor openings with respect to the line leading to the reversing region. In accordance with this aspect of the invention, a restrictor controlled by the high pressure or the high pressure side is provided with a cross-section restricting the flow which is matched to the respective high pressure and therefore results in an optimum manner in a continuous pressure increase or pressure drop in the cylinder openings passing the reversing regions.

The line of the reversing region opening into the control cylinder can be connected to the line leading to the high pressure control opening or the low pressure control opening respectively by an axial groove with changing cross-section of the control piston, with the changing cross-section being adapted to the respective axial piston machine on the basis of calculations or experience.

In accordance with another embodiment, it is provided that the connection of the control cylinder to the line leading to the reversing region consists of a slot which the control piston releases in a different length in accordance with its displacement on the basis of the high pressure loaded on one side. The released length corresponds to the respective flow cross-section of the controlled restrictor which is matched to the respective axial piston machine.

In accordance with a preferred embodiment, it is provided that the control piston is loaded on one side by at least two mutually encompassing compression springs, of which the spring(s) following the first spring come into use successively in accordance with the displacement of the control piston in the direction of the springs, that is load the control piston with their force. A roughly hyperbolic spring characteristic curve can be provided by this aspect which takes the path of the control piston and the increasing pressure on the high pressure side better into account.

For example, the pressure increases with a constant power and a reduced swivel angle of the slanting disk with a correspondingly reduced volume flow. To take different operating states, for example the pressure change and the change in the volume flow into account in a change of the slanting angle of the slanting disk, a certain control characteristic has to be achieved with respect to the restrictor opening changing its cross-section which takes the special spring characteristic and spring characteristic curve into account. With a change in the slanting angle of the slanting disk, the dead volume in the cylinder between the piston and the control body changes such that changed circumstances result which are taken into account by the restrictor controlled in accordance with the invention. If namely the swivel angle is also changed in addition to the high pressure, a control of the restrictor opening which takes this change into account is also required.

In accordance with another embodiment of the invention, it is provided that the control piston is displaced in the control cylinder by a setting device whose setting path is determined by a control device, for example a computer, in dependence on the high pressure, the speed and the swivel angle of the slanting disk. The values influencing the setting path of the control piston, which result for the respective axial piston machine from the changing high pressure, the changing speed and the changing swivel angle, can be stored in tables (ROM) in the memory of the computer so that the computer adjusts the control piston in accordance with the respectively measured high pressure, the respectively measured speed and the respective swivel angle of the slanting disk.

In accordance with another embodiment of the invention, it is provided that the control piston is formed as a step piston whose annular piston surface and whose disk-shaped piston surface is exposed on the one hand to the high pressure and on the other to a pressure corresponding to the set slanting angle of the slanting disk. The pressure corresponding to the slanting angle of the slanting disk can be carried off, for example, from the pressure in a setting cylinder which adjusts the slanting disk and is proportional to the angle adjustment of the slanting disk.

In accordance with a further aspect of the invention, it is provided that the control piston is formed as a three-stage piston whose piston surfaces formed by the two annular surfaces and the center disk-shaped surface are each exposed to pressures which correspond to the high pressure in the high pressure control opening, to the slanting angle of the slanting disk and to the speed. The pressure corresponding to the speed can be carried off, for example, by an auxiliary pump which is driven by the axial piston machine and which produces a pressure proportional to the speed.

In accordance with a preferred embodiment, it is provided that the boreholes opening into the reversing regions are formed by the boreholes of a constant restrictor. In accordance with the invention, each inlet restrictor has at least two restrictor cross-sections, with the one restrictor being a constant restrictor and being accommodated in the control plate and the other restrictor(s) being accommodated in the vicinity of the control surface of the control body or in the control body itself, with the cross-section(s) of the controllable restrictors being controlled in accordance with the operating states of the axial piston machine such that the pressure build-up and the pressure drop takes the designed course in the controlled cylinder space.

In the described embodiments of the invention, it is possible that a certain volume of pressure oil is taken from the high pressure side, that is the high pressure control openings, which is then lacking in the flowing pressure medium. A lack of pressure medium on the high pressure side can, however, result in turn in unwanted pulsations. For this reason, in accordance with another preferred embodiment of the invention, it is provided that the controlled restrictor is supplied with pressure oil from an external pressure oil source.

BRIEF DESCRIPTION OF THE DRAWINGS

Embodiments of the invention are described in the following in more detail with reference to the drawing, in which are shown.

DESCRIPTION OF THE PREFERRED EMBODIMENTS

Figure 2:
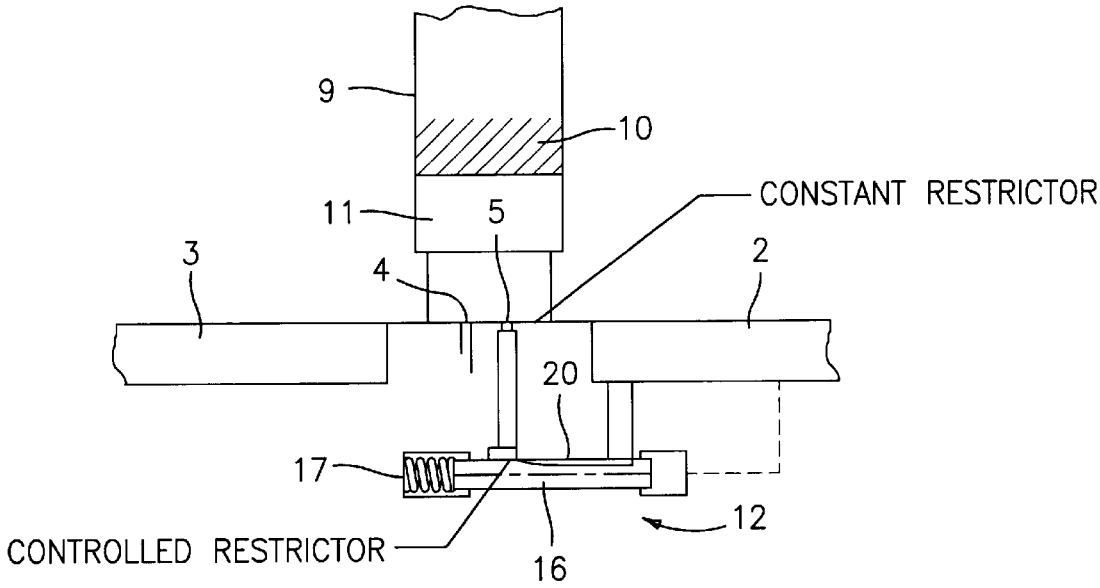
FIG. 2 a section through the control body and a cylinder along the line II—II in FIG. 1 in a schematic representation.
Figure 1:
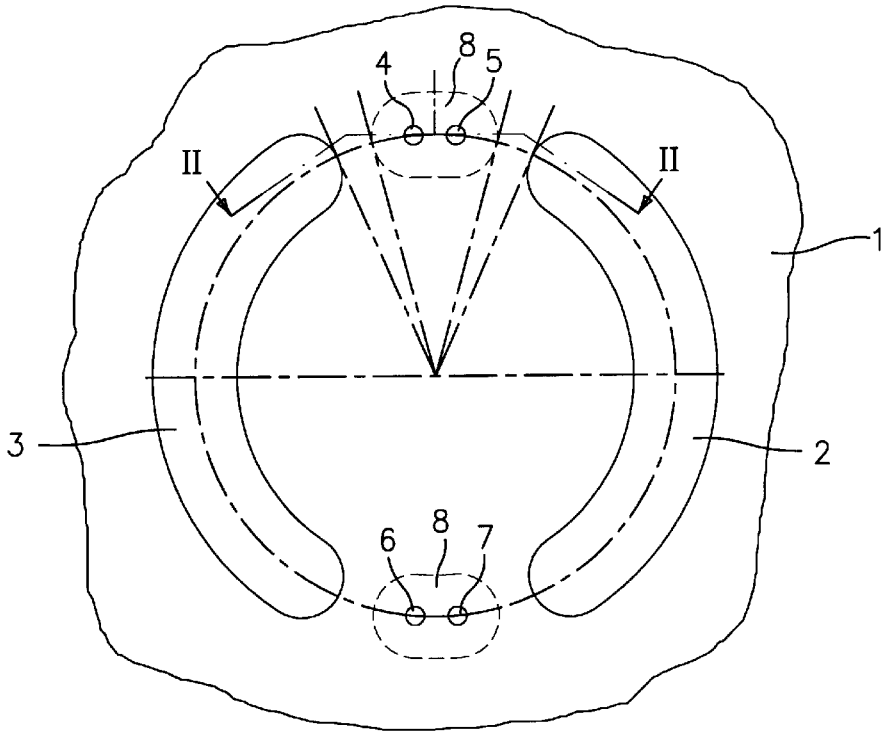
FIG. 1 a plan view of the control surface of the control body with the position of the cylinder openings in the reversing regions indicated by broken lines.

FIGS. 1 and 2 schematically show a control body 1 of which in FIG. 1 only the control surface with the high pressure control opening 2 and the low pressure control opening 3 and the restrictors boreholes 4, 5 and 6, 7 located in the reversing regions between the low pressure and the high pressure openings are shown. The control surface of the control body is swept over by the roughly oval formed openings 8 of the cylinders 9 which are shown by broken lines in FIG. 1.

The hydraulic connections of the low pressure and the high pressure control openings 2, 3 are of a conventional kind and therefore not represented.

A dead space 11 is set in the cylinders 9 between the pistons 10 and the openings 8 sliding on the control surface of the control body 1 in accordance with the respective slanting angle of the slanting disk, said dead space 11 having to be taken into account in the control of the restrictor openings formed by the boreholes, 4 to 7.

The restrictor openings 4 to 7 have a constant cross-section and thus, as can be seen from FIG. 2, form constant restrictors.

Figure 5:
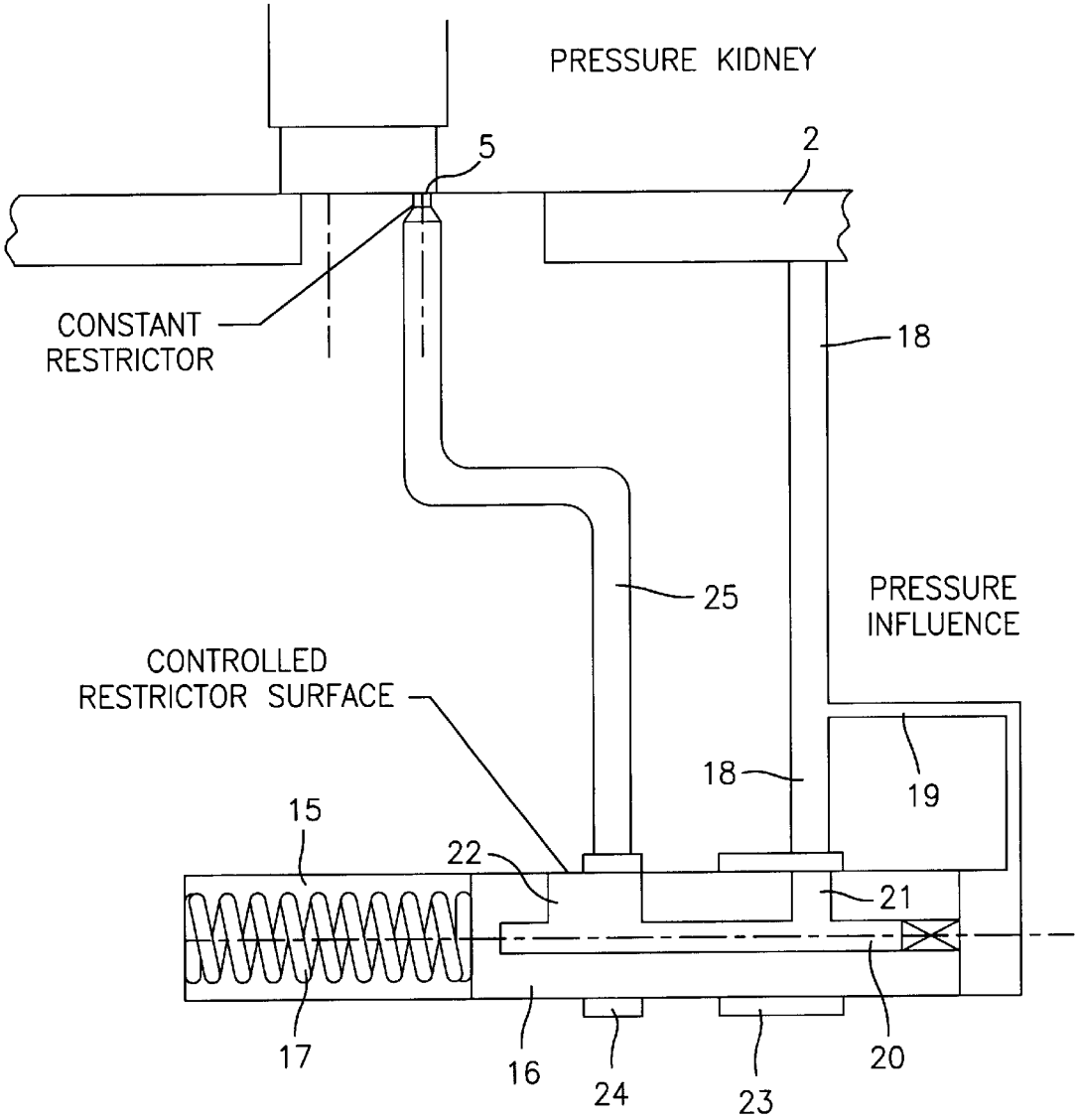
FIG. 5 a controlled restrictor of the kind visible from FIG. 2 in an enlarged representation.

For the control of the pressure media flowing through the constant restrictors, a controlled restrictor 12 is provided which is described in more detail with reference to FIG. 5.

A control piston 16 is displaceably arranged in a borehole 15 of the control body 1 forming a control cylinder or in a cylinder connected in particular to the control body 1 by lines. This control piston is loaded by a compression spring 17 which is clamped between the base of the cylinder 15 and the side of the control piston 16 facing this. The opposite side of the control piston is exposed to the high pressure, that is to the pressure which prevails in the high pressure control opening 2 of the control body 1. For this purpose, the side of the cylinder opposite the compression spring 17 is connected to the high pressure control opening 2 via a line 18 and a branch line 19. The high pressure could naturally also be carried off by another part of the axial piston machine. The control piston 16 is provided with an axial borehole 20 closed at its ends which is in connection with radial boreholes or slots 21, 22. The radial borehole 21 is exposed to the pressure of the pressure medium in the high pressure control opening 2 via the line 18 and an annular space 23. The borehole, or preferably the slot 22, is in connection with an annular space 24 from which a line 25 leads to the restrictor opening 5 in the control surface of the control body 1. The piston 16 is displaced in the cylinder borehole by the high pressure acting on the right piston surface against the force of the compression spring 17, with a control slot 22 of different length being controlled open according to the displacement path which corresponds to the respective length of the control slot detected by the annular space 24.

In the embodiment of FIG. 2, the control piston 16 is provided with an axial slot which has a changeable cross-section so that restrictor cross-sections of different size are controlled open with the line leading to the restrictor opening 5 corresponding to the displacement of the control piston.

Volume is guided from the high pressure control opening into the cylinder spaces of the cylinder boreholes via the controlled restrictor and the constant restrictor to build up the pressure in the cylinder boreholes. The volume flowing in the control time can be influenced by the controlled restrictor such that the desired pressure development is reached in the cylinder borehole. The influencing of the restrictor cross-section can be achieved via the connection between the pressure prevailing in the control openings and the open restrictor cross-section both via the compression spring and via the shape of the restrictor.

Figure 3:
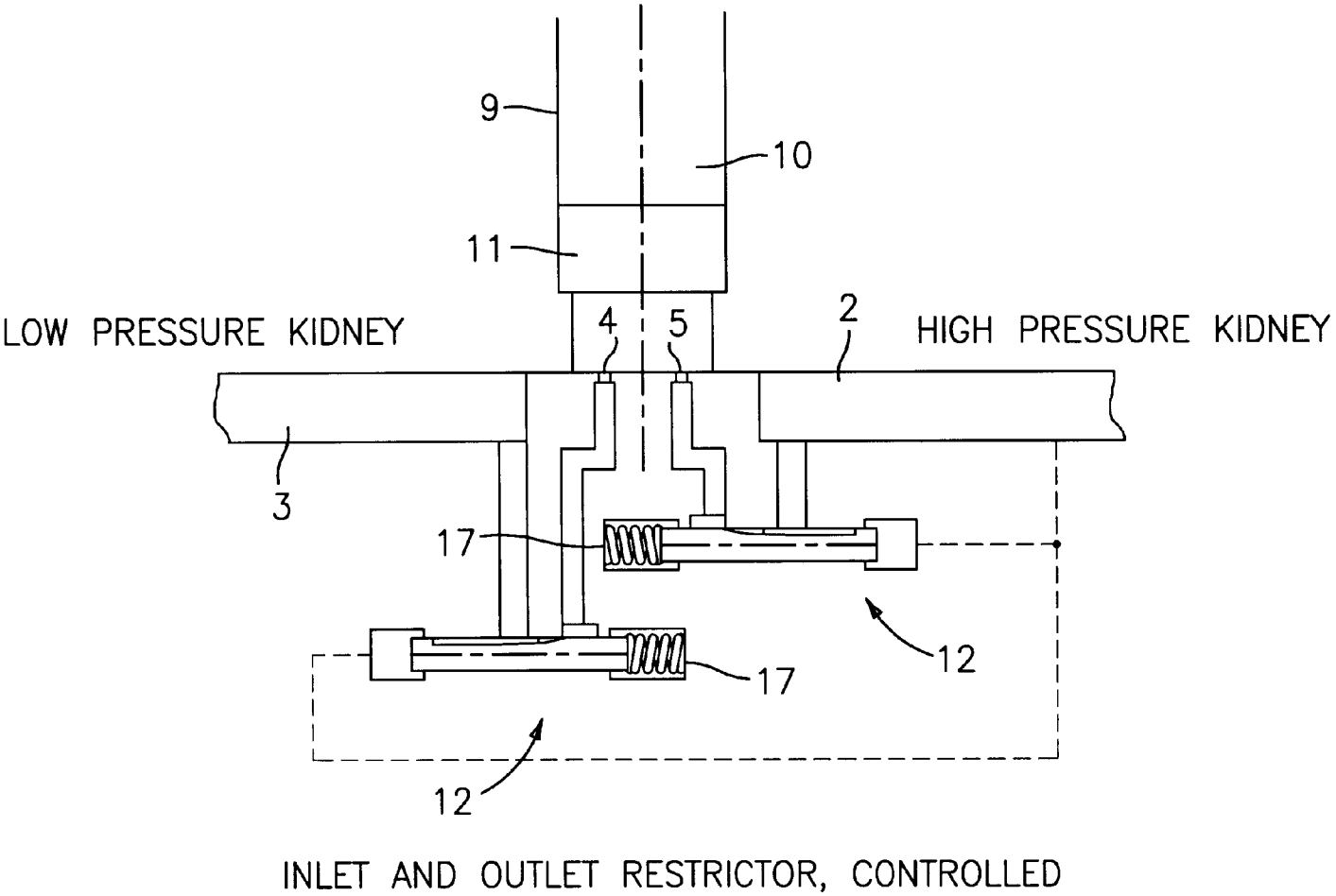
FIG. 3 a representation corresponding to FIG. 2 in which the borehole facing the low pressure control opening is provided with a controlled restrictor in the reversing range.

In the embodiment of FIG. 3, the restrictor openings 5 of constant cross-section in the reversing region are provided with controlled restrictors 12 on the sides facing the low pressure and the high pressure control openings 2, 3. The controlled restrictors 12 are in both cases exposed to the high pressure on their sides opposite the compression springs 17 which is preferably carried off in the shape shown in broken lines via lines from the high pressure control opening 2.

A particular feature of the invention can be seen in the fact that on the passing of the preferably oval cylinder openings over the control surfaces of the control body, the cylinder opening 8 covers both restrictor openings 4, 5 so that a smoothing pressure compensation takes place.

Figures 4, 4A, 4B:
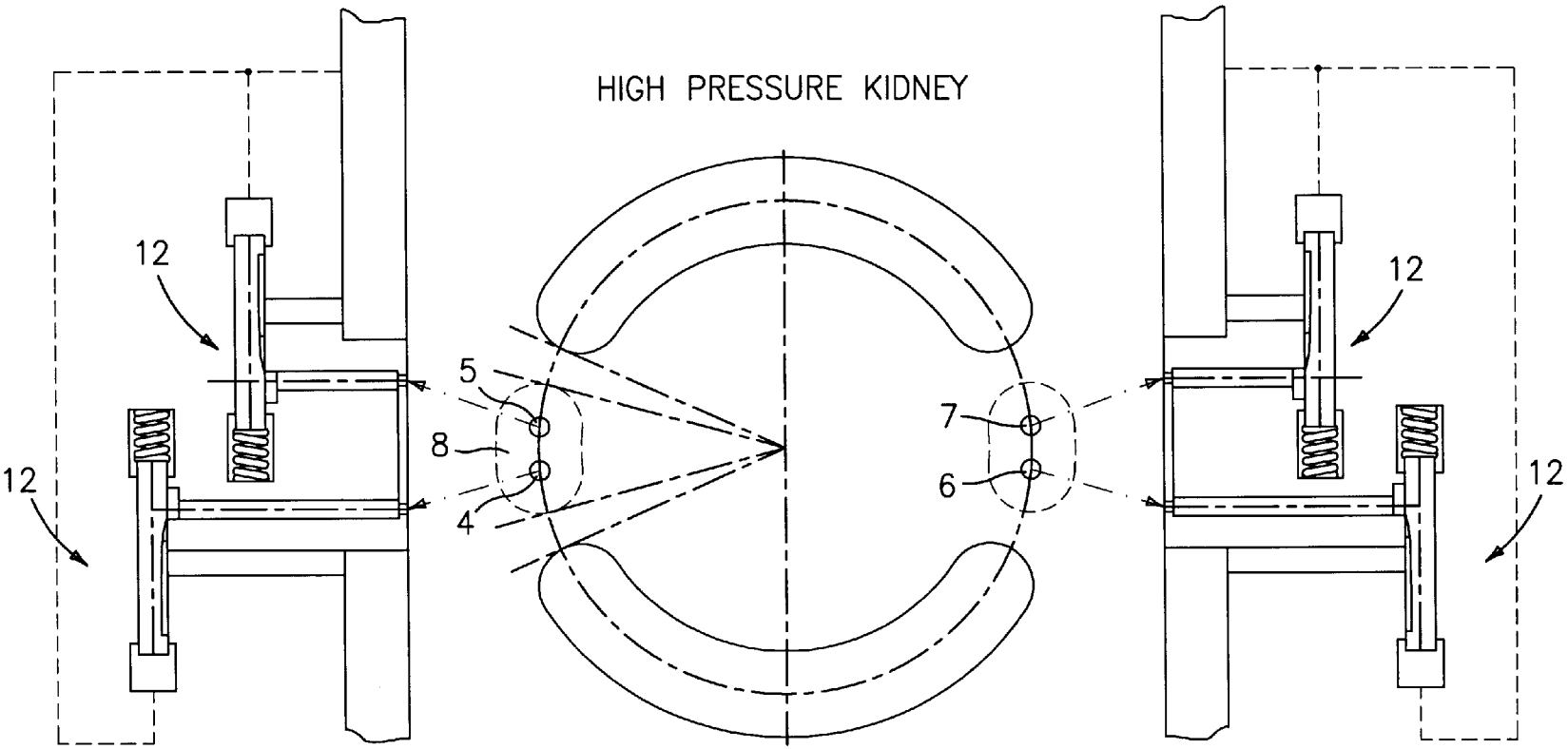
FIGS. 4, 4*a* and 4*b* representations corresponding to FIGS. 1 to 3 in which the two respective boreholes arranged in the two reversing regions are provided with controlled restrictors.

In accordance with the embodiment of FIGS. 4, 4*a* and 4*b*, it is provided that in both reversing regions, that is in the two regions between the low pressure and high pressure control openings, restrictor boreholes 5 are arranged which are connected to changing restrictor openings via the controlled restrictors 12 such that an optimum pressure compensation can take place when the cylinder openings run over the reversing regions.

Figure 6:
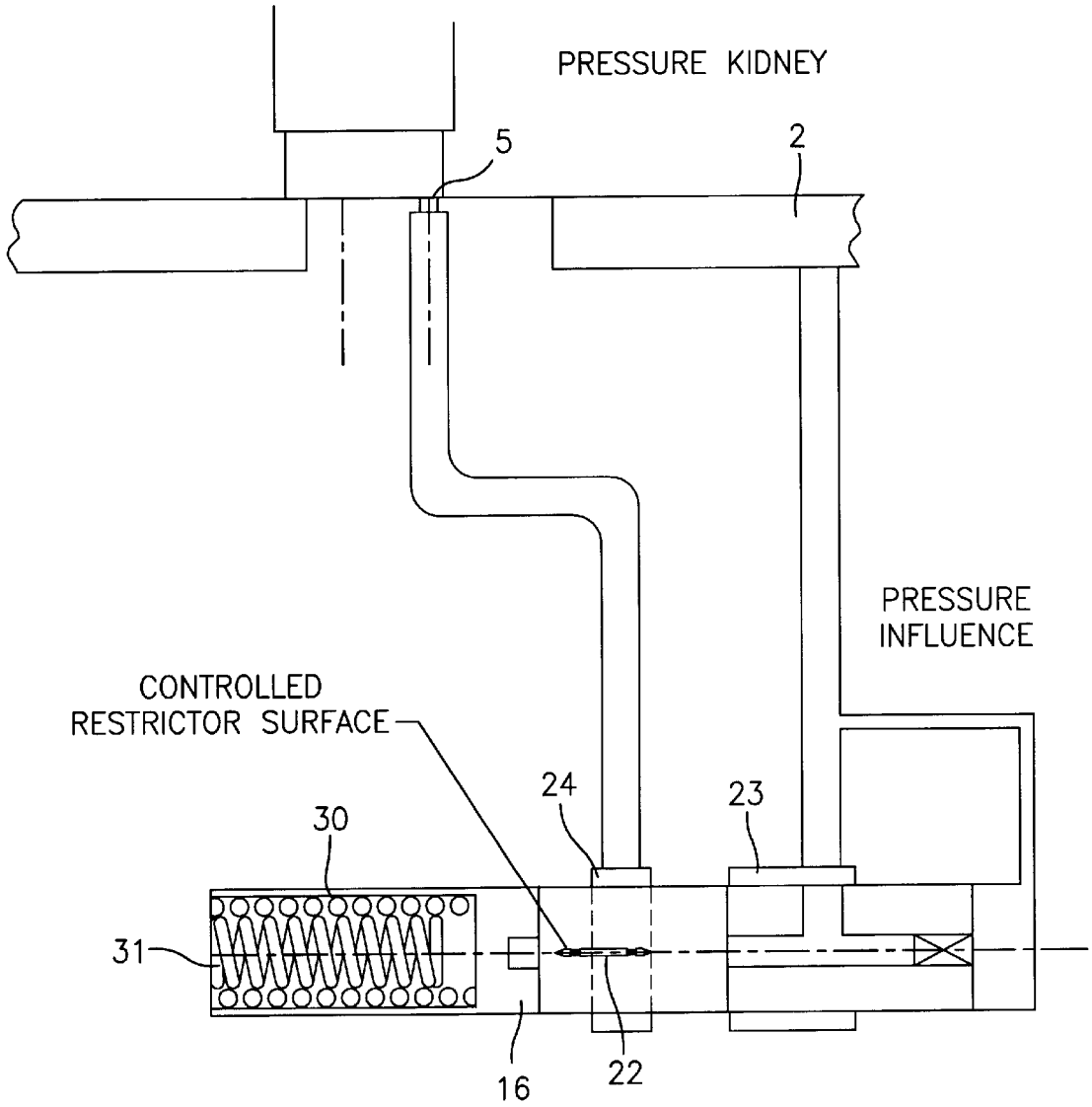
FIG. 6 a representation corresponding to FIG. 5 of a controlled restrictor in which the control piston can be loaded by mutually encompassing compressing springs.

In the embodiment in accordance with FIG. 6, the control piston is loaded by a compression spring 30 which encompasses a compression spring 31 of shorter length in the manner that this only additionally engages at the control piston 16 after a pre-determined displacement path and thereby changes the spring characteristic curve and engages a hyperbolic curve.

Figure 7:
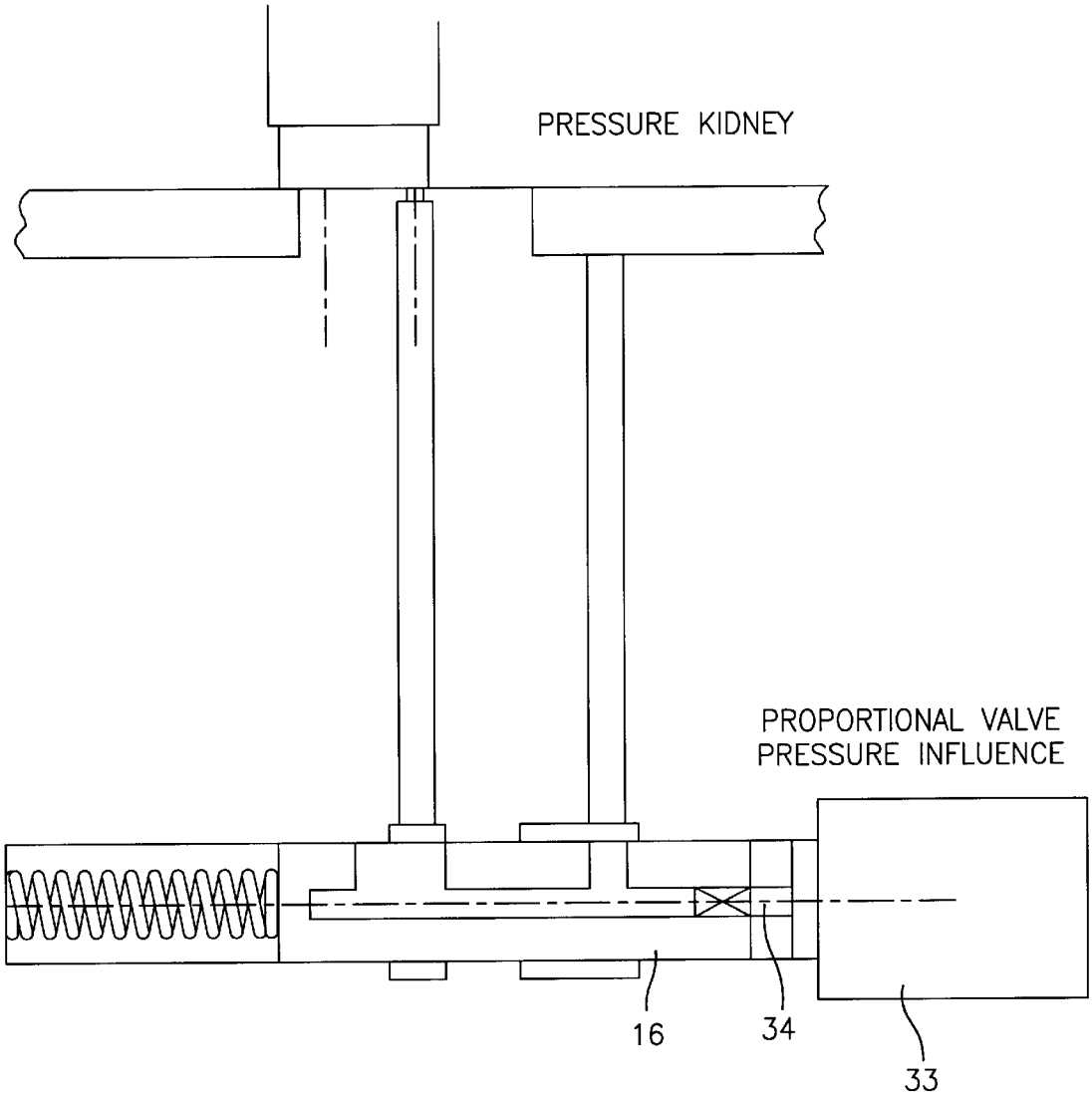
FIG. 7 a representation corresponding to FIG. 6, in which the control piston can be displaced by a setting device controlled by a control device.

In the embodiment in accordance with FIG. 7, a displacement device 33 is provided which displaces the control piston 16 via a slide 34, with the displacement device 33 being controlled by a control device, for example a computer, which calculates a setting path for the slide 34 from the pressure of the high pressure side, the speed and the swivel angle. The path of the restrictor piston is appropriately controlled by a proportional magnet, that is the setting force of the magnet is dependent on the magnitude of the applied electrical voltage. The relationship voltage—setting path is made via the compression spring. This proportional magnet can be controlled by any electrical signals. The pressure development in the cylinder borehole can thus be influenced in dependence on different values, for example pressure, swivel angle and speed.

Figure 8:
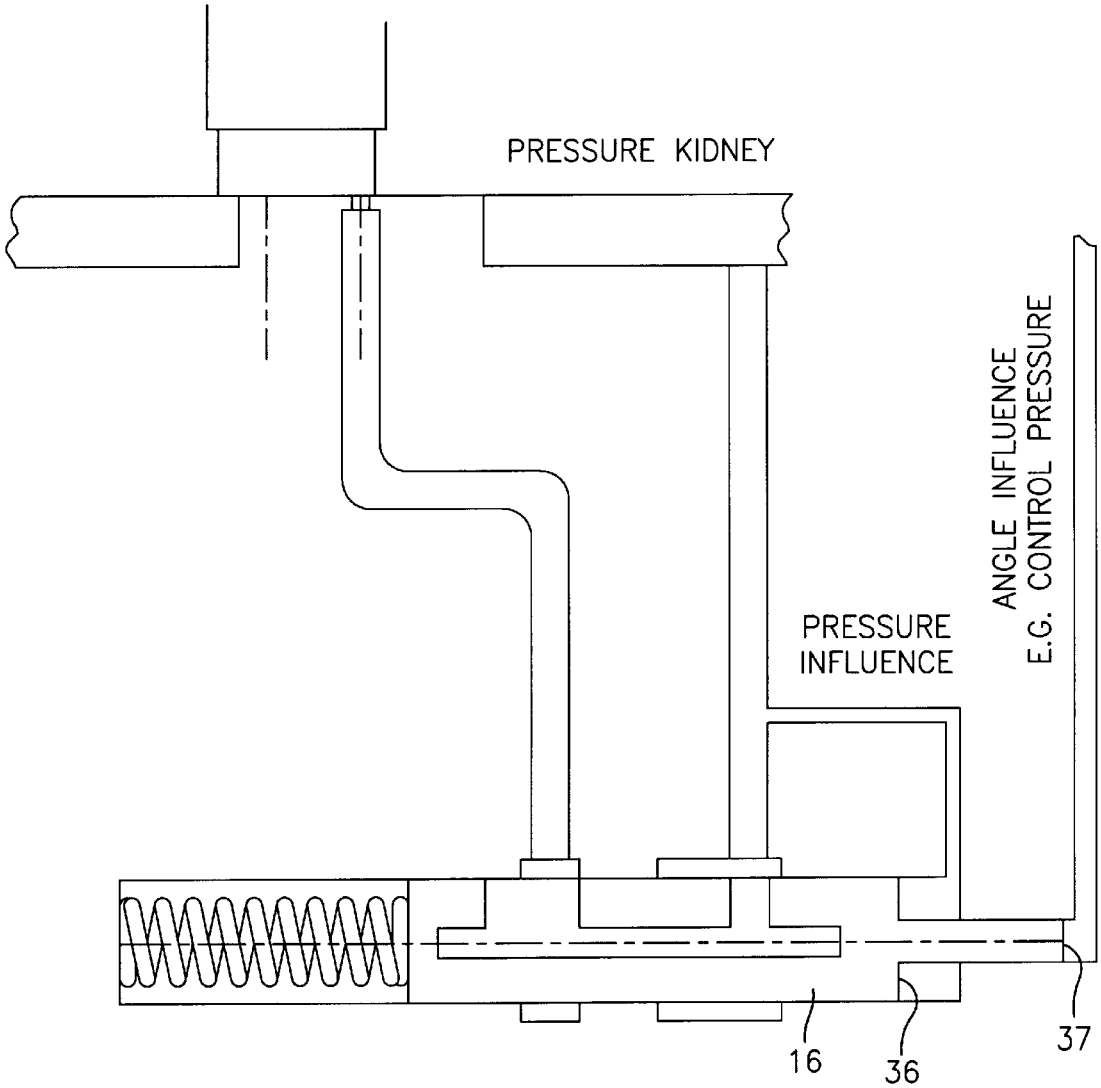
FIG. 8 a representation corresponding to FIG. 5, in which the control piston can be displaced by a stage piston.

In the embodiment in accordance with FIG. 8, the control piston 16 is designed as a stage piston, with the annular surface 36 of the stage piston being exposed to the pressure of the high pressure side and the piston surface 37 of the piston with a lower cross-section to a liquid pressure which corresponds to the slanting angle of the slanting disk.

Figure 9:
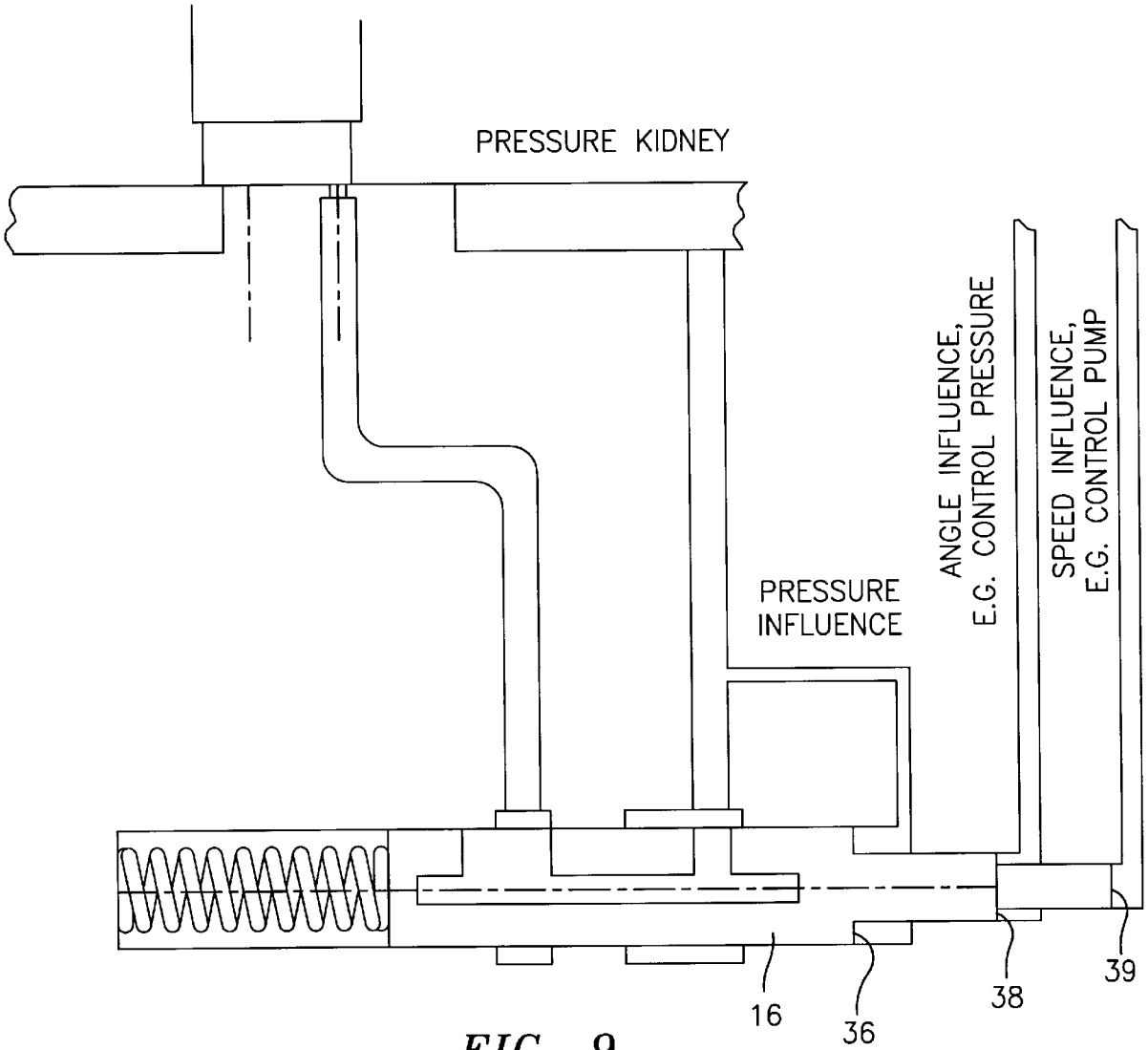
FIG. 9 a representation corresponding to FIG. 8 in which the control piston can be displaced by a three-stage piston arrangement.

In the embodiment in accordance with FIG. 9, the control piston is designed as a three-stage piston with the annular surfaces 36 and 38 being exposed to the high pressure and a pressure which corresponds to the slanting angle of the slanting disk and the face 39 of the piston section with the smallest cross-section being exposed to a pressure which is proportional to the speed of the axial piston machine.

Figure 10:
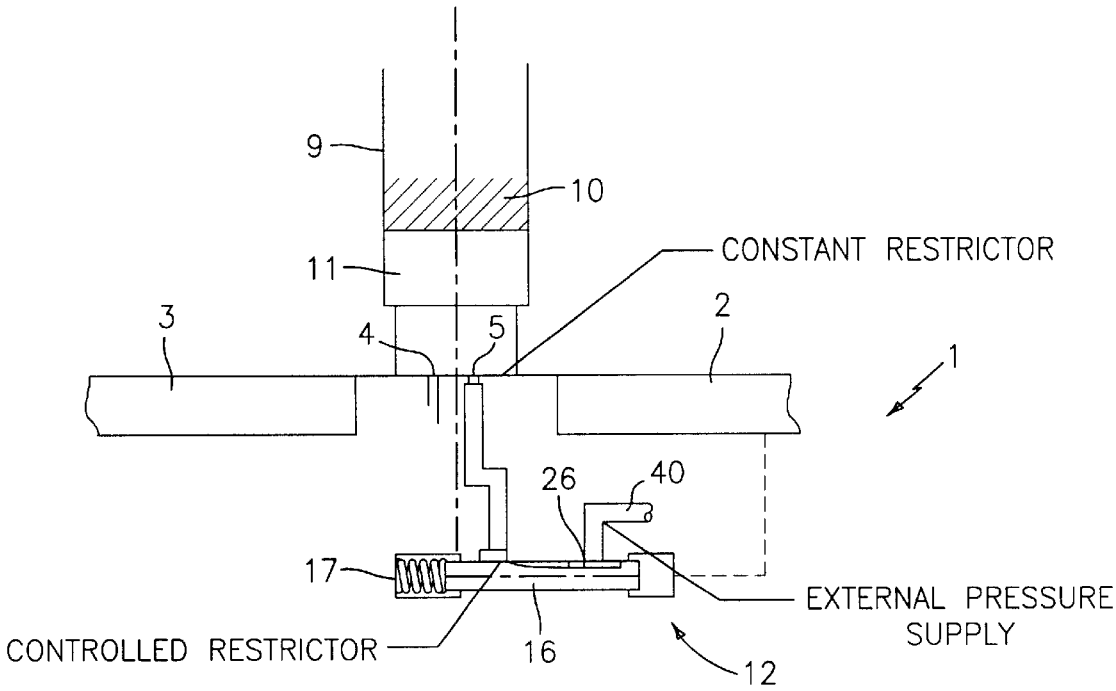
FIG. 10 a representation corresponding to FIG. 1 in which the borehole in the reversing region is supplied with pressure oil from an external pressure source via the controlled restrictor.

In the embodiment in accordance with FIG. 10, it is provided that the controlled restrictor 12 is supplied with a pressure medium from an external pressure means source via the line 40.

Figure 11:
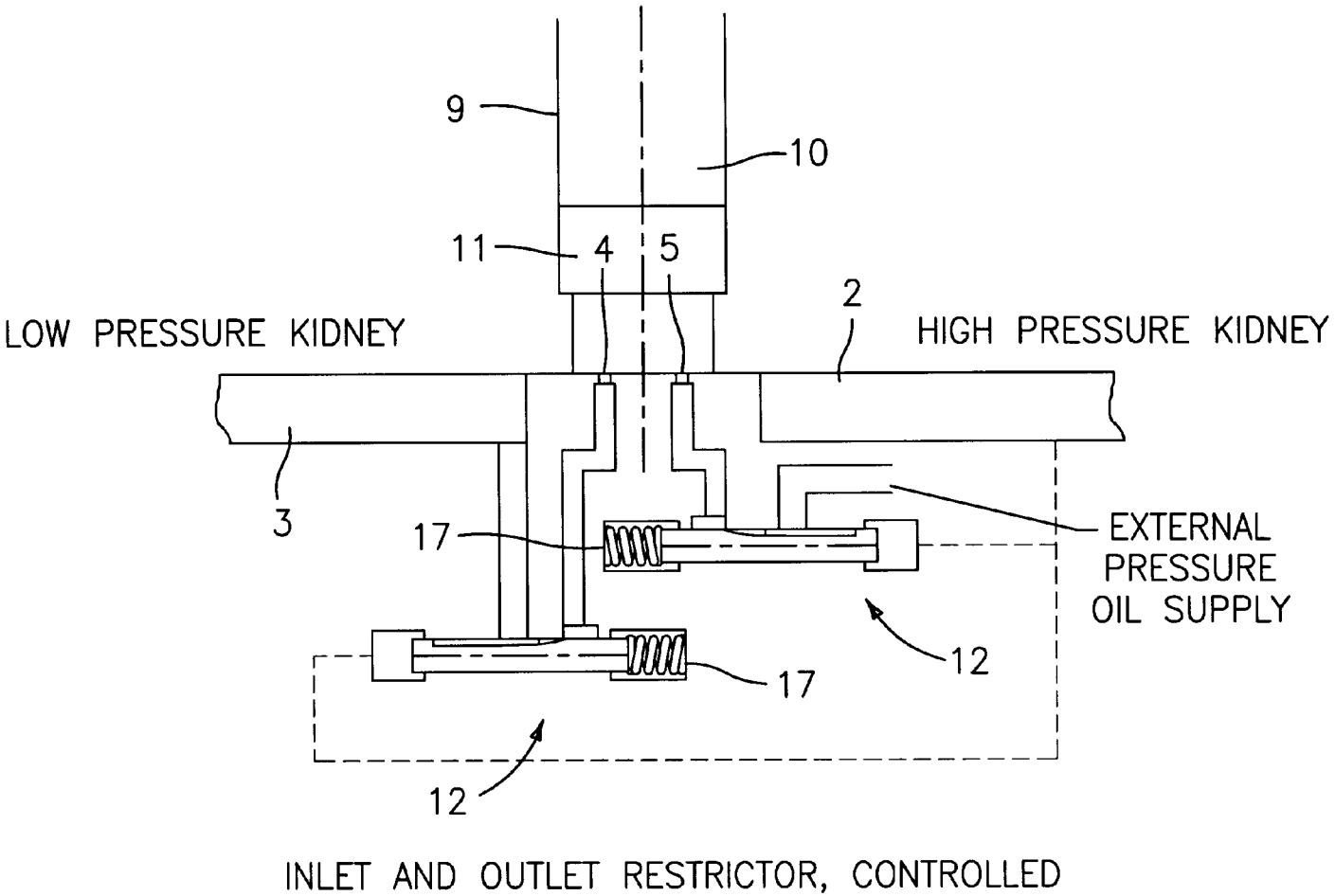
FIG. 11 a representation corresponding to FIG. 1 in which the two boreholes of the reversing region, which are located on the sides facing the low pressure and the high pressure control openings, are controlled by controlled restrictors.

FIG. 11 shows an embodiment in which both restrictor openings are controlled by controlled restrictors in the reversing region, with the oil supply of the restrictor opening 5 facing the high pressure control opening 2 taking place via an external pressure oil supply.

Figure 12:
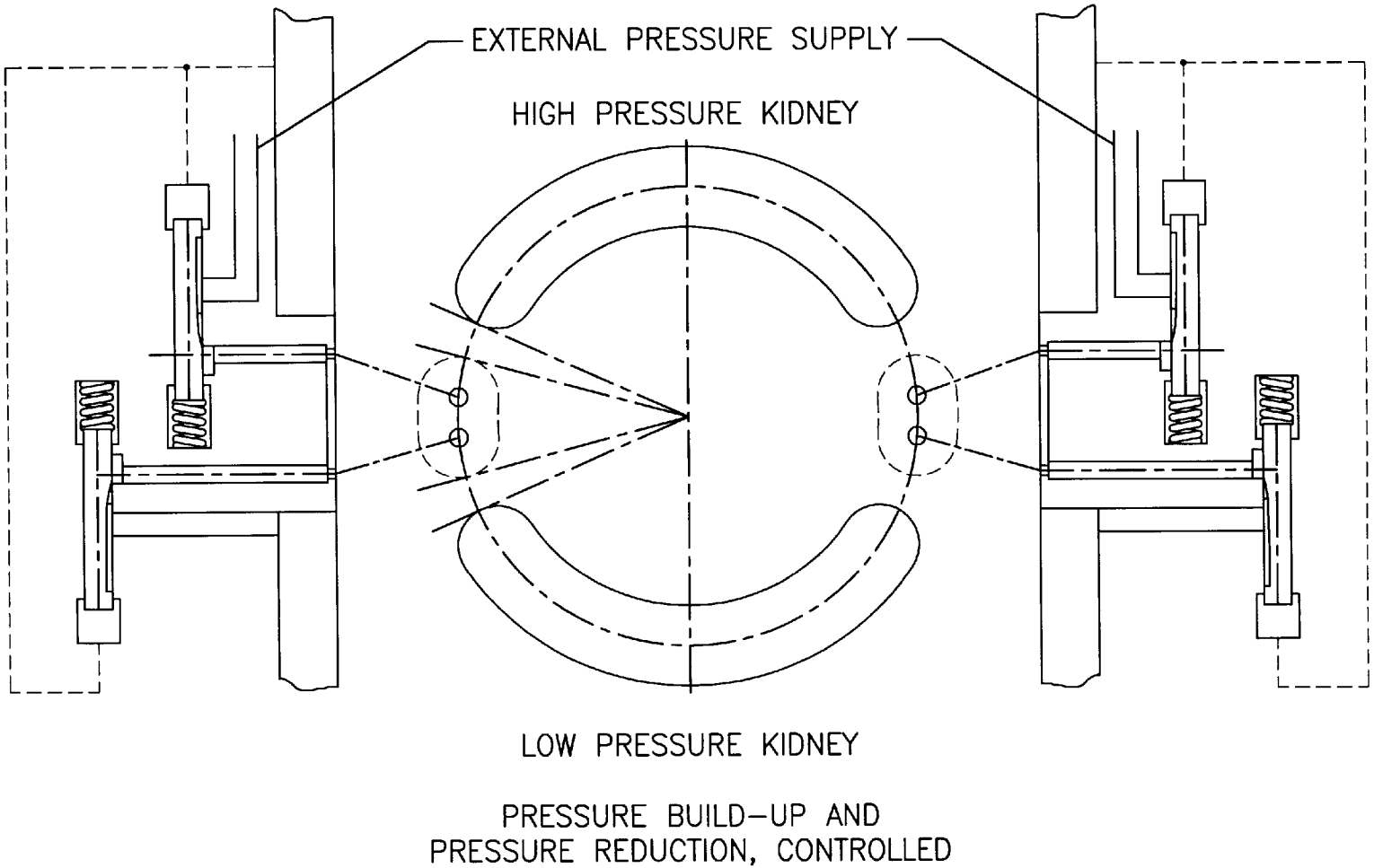
FIG. 12 a schematic representation of a control body in which all boreholes of the reversing regions are controlled by controlled restrictors and the boreholes are connected to an external pressure means source.

In the embodiment in accordance with FIG. 12, all boreholes of the two reversing regions are provided with controlled restrictors, with the controlled restrictors on the high pressure side being supplied with medium under pressure from an extreme pressure oil source. The supply of pressure oil from external pressure oil sources can be advantageous in certain cases. On the one hand, the pulsation in the high pressure control opening can be reduced by the external pressure oil supply and, on the other hand, a different desired pressure curve characteristic can be achieved in the cylinder boreholes by the higher pressure for the supply of the restrictor system.

Figure 14:
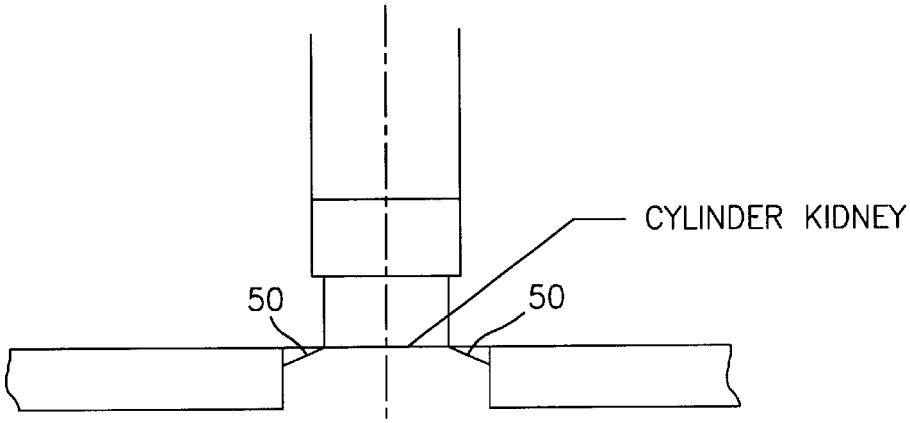
FIGS. 13 to 16 known embodiments of control bodies.
Figure 13:
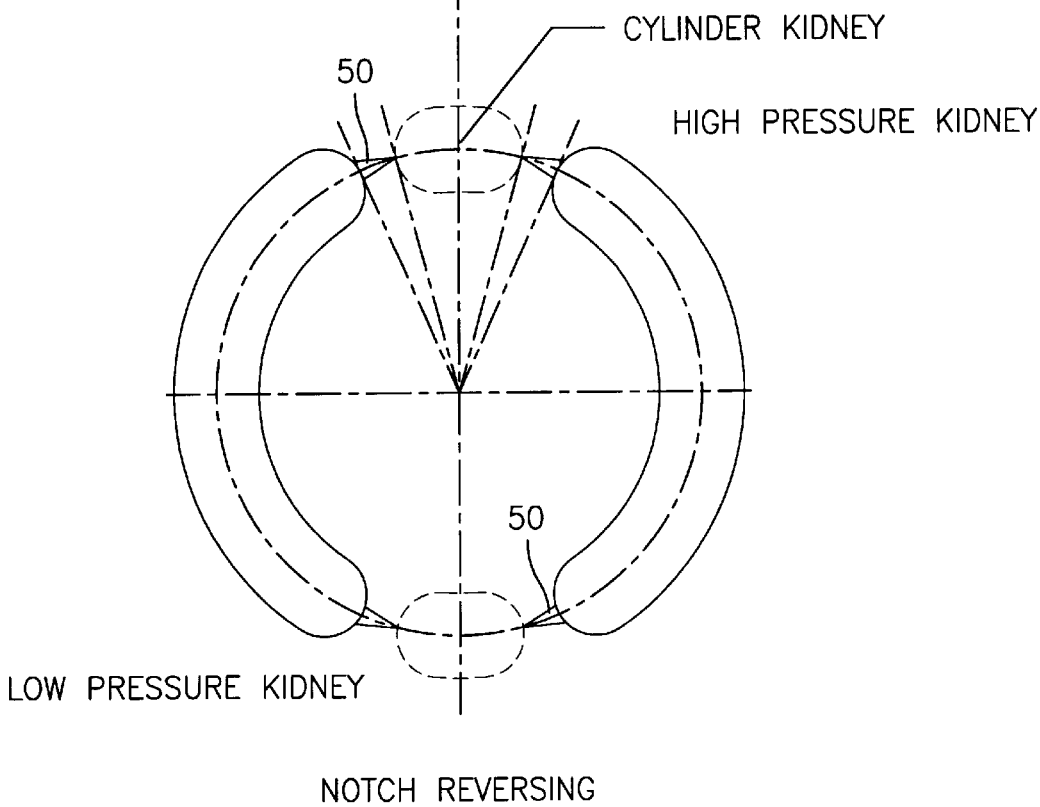

Known control bodies can be seen from FIGS. 13 and 14 in which the reversing regions are connected to the adjacent low pressure and high pressure control openings by slots or notches 50 narrowing in a wedge-shaped manner.

Figure 15:
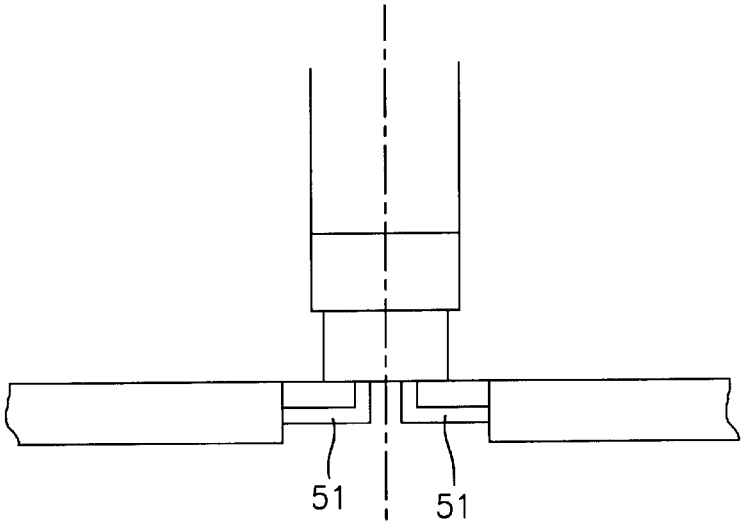
Figure 16:
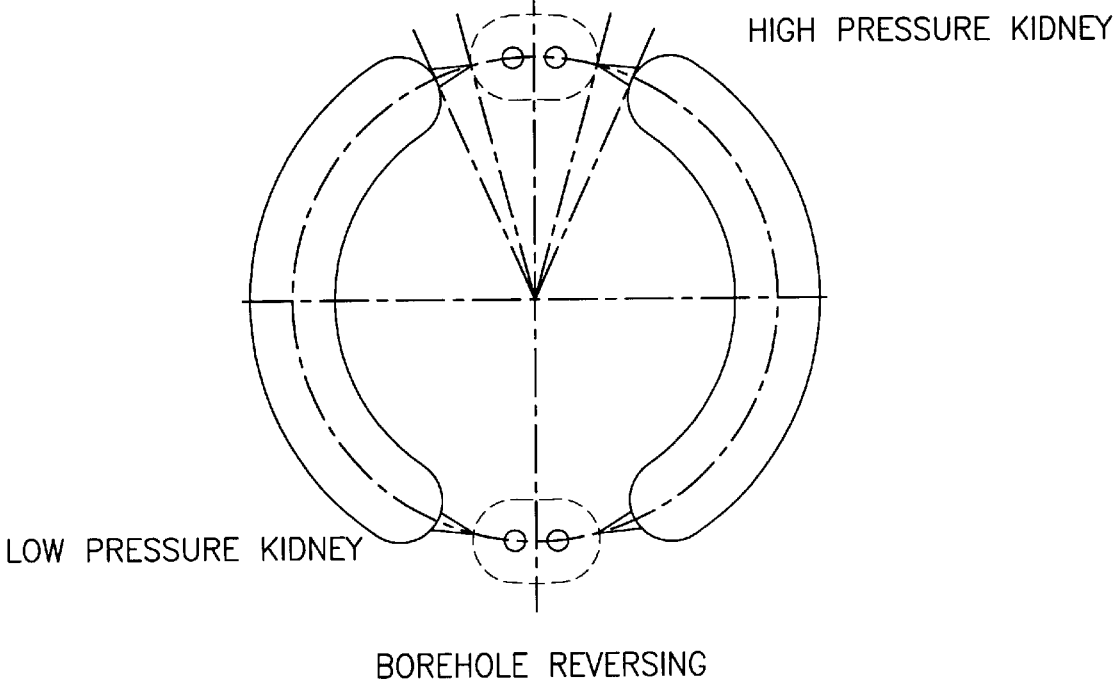

Known control bodies are also visible from FIGS. 15 and 16 in which the low pressure and high pressure control openings are connected to the restrictor boreholes in the reversing region directly by lines 51.

What is claimed is:

1. A hydrostatic axial piston machine having a drum-like cylinder block which is supported in a manner fixed against rotation on a driving or output shaft and is provided concentrically and parallel to its center line with cylinder openings (8) in which axially displaceable pistons (10) are arranged which are supported via spherical heads on a slanting disk, wherein the cylinder openings (8) opposite the slanting disk sweep over roughly kidney-shaped low pressure (3) and high pressure (2) control openings of a control body (1), between which reversing regions boreholes (4, 5, 6, 7) are located, at least one (5) of the boreholes (4, 5) opening in the reversing region of the control body (1), is connected to a high pressure side or the high pressure control opening (2) by a line, and a control piston restrictor (12) controlled by the high pressure is arranged in the line (18, 19) which varies a restrictor opening (20) in response to the high pressure in the line.

2. An axial piston machine in accordance with claim 1, wherein the at least one borehole (5) opens in a region of a reversing range of the control body (1) which is facing the high pressure control opening (2).

3. An axial piston machine in accordance with claim 1, wherein the controlled restrictor comprises a cylindrical borehole (20) in the control body (1), in which borehole (20) the control piston (16) loaded by a compression spring (17) is displaceably guided whose side opposite the compression spring (17) is exposed to the high pressure in the high pressure control opening (2);

lines (18, 25) open into the cylindrical borehole (20) at an axial distance to one another, which lines (18, 25) lead to the borehole (5) of the reversing region and the high pressure control opening (2) or the low pressure control opening (3); and the control piston (16) releases restrictor openings of different size with respect to the line leading to the reversing region according to its displacement.

4. An axial piston machine in accordance with claim 1, wherein the at least one borehole (4 or 5) of the reversing region opening into the control body (1) is connected by an axial groove (20) of changing cross-section of the control piston (16) to the line leading to the high pressure control opening (2) or low pressure control opening (3).

5. An axial piston machine in accordance with claim 1, wherein the connection of the control body (1) to the at least one borehole (4 or 5) leading to the reversing region comprises a slot (21, 22) which the control piston (16) releases in a different length according to its displacement on the basis of the high pressure loaded on one side.

6. An axial piston machine in accordance with claim 3, wherein the control piston (16) is exposed on one side to at least two mutually encompassing compression springs (30, 31) of which a second spring (31) following a first one (30) of the springs (30, 31) comes into use successively in accordance with displacement of the control piston (16) in a direction towards the springs (30, 31).

7. An axial piston machine in accordance with claim 3, wherein the control piston (16) is displaced in the cylindrical borehole (20) by a setting device whose setting path is determined by a control unit, in dependence on high pressure, speed and swivel angle of the slanting disk.

8. An axial piston machine in accordance with claim 1, wherein the control piston (16) is formed as a stage piston, whose annular piston surface and whose disk-shaped piston surface are exposed on the one hand to the high pressure and on the other hand to a pressure corresponding to the slanting angle of the slanting disk.

9. An axial piston machine in accordance with claim 1, wherein the control piston (16) is formed as a three-stage piston whose piston surfaces formed by two annular surfaces (36,38) and a central disk-shaped surface (39) are each exposed to pressures which correspond to the high pressure in the high pressure control opening (2), slanting angle of the slanting disk and speed.

10. An axial piston machine in accordance with claim 1, wherein the boreholes (4, 5) opening into the reversing regions are formed by boreholes of a constant restrictor.

11. An axial piston machine in accordance with claim 1, wherein the controlled restrictor (12) is supplied with pressure oil from an external pressure oil source.

12. An axial piston machine in accordance with claim 2, wherein at least in the reversing region of the control body (1) facing the low pressure control opening (3), a borehole (4) opens which is connected to the low pressure control opening (3) by a line; and the restrictor (12) controlled by the high pressure is arranged in the line which releases the restrictor open corresponding to the high pressure in the line.

13. An axial piston machine in accordance with claim 2, wherein the controlled restrictor comprises a cylindrical borehole (20) in the control body (1), in which borehole (20) the control piston (16) loaded by a compression spring (17) is displaceably guided whose side opposite the compression spring (17) is exposed to the high pressure in the high pressure control opening (2);

lines (18, 25) open into the cylindrical borehole (20) at an axial distance to one another, which lines (18, 25) lead to the borehole (20) of the reversing region and the high pressure control opening (2) or low pressure control opening (3); and the control piston (16) releases restrictor openings of different size with respect to the line leading to the reversing region according to its displacement.

14. An axial piston machine in accordance with claim 2, wherein the at least one borehole (4 or 5) of the reversing region opening into the control body (1) is connected by an axial groove (20) of changing cross-section of the control piston (16) to the line leading to the high pressure control opening (2) or low pressure control opening (3).

15. A hydrostatic axial piston machine having a drum-like cylinder block which is supported in a manner fixed against rotation on a driving or output shaft and is provided concentrically and parallel to its center line with cylinder openings (8) in which axially displaceable pistons (10) are arranged which are supported via spherical heads on a slanting disk, wherein the cylinder openings (8) opposite the slanting disk sweep over roughly kidney-shaped low pressure (3) and high pressure (2) control openings of a control body (1), between which reversing regions boreholes (4,5,6,7) are located, at least one (5) of the boreholes (4,5) opening in the reversing region of the control body (1), is connected to a high pressure side or the high pressure control opening (2) by a line, a restrictor (12) controlled by the high pressure is arranged in the line (18, 19) which varies a restrictor opening (20) in response to the high pressure in the line, at least in the reversing region of the control body (1) facing the low pressure control opening (3), a borehole (4) opens which is connected to the low pressure control opening (3) by a line, and the restrictor (12) controlled by the high pressure is arranged in the line which releases the restrictor opening corresponding to the high pressure in the line.

16. An axial piston machine in accordance with claim 15, wherein the cylinder openings (8) cover both boreholes (4,5) on passing over the reversing region of the control body (1).

17. An axial piston machine in accordance with claim 15, wherein the controlled restrictor comprises a cylindrical borehole (20) in the control body (1), in which borehole (20) a control piston (16) loaded by a compression spring (17) is displaceably guided whose side opposite the compression spring (17) is exposed to the high pressure in the high pressure control opening (2);

lines (18, 25) open into the cylindrical borehole (20) at an axial distance to one another, which lines (18, 25) lead to the borehole (20) of the reversing region and the high pressure control opening (2) or low pressure control opening (3); and the control piston (16) releases restrictor openings of different size with respect to the line leading to the reversing region according to its displacement.

18. An axial piston machine in accordance with claim 16, wherein the controlled restrictor comprises a cylindrical borehole (20) in the control body (1), in which borehole (20) a control piston (16) loaded by a compression spring (17) is displaceably guided whose side opposite the compression spring (17) is exposed to the high pressure in the high pressure control opening (2);

lines (18, 25) open into the cylindrical borehole (20) at an axial distance to one another, which lines (18, 25) lead to the borehole (20) of the reversing region and the high pressure control opening (2) or low pressure control opening (3); and the control piston (16) releases restrictor openings of different size with respect to the line leading to the reversing region according to its displacement.

19. An axial piston machine in accordance with claim 15, wherein the at least one borehole (4 or 5) of the reversing region opening into the control body (1) is connected by an axial groove (20) of changing cross-section of a control piston (16) in the restrictor (12) to the high pressure control opening (2) or low pressure control opening (3).

20. An axial piston machine in accordance with claim 16, wherein the at least one borehole (4 or 5) of the reversing region opening into the control body (1) is connected by an axial groove (20) of changing cross-section of a control piston (16) in the restrictor (12) to the high pressure control opening (2) or low pressure control opening (3).

* * * * *